US010709266B1

(12) United States Patent
Borgen et al.

(10) Patent No.: US 10,709,266 B1
(45) Date of Patent: Jul. 14, 2020

(54) REFRIGERATOR DISPLAY CASE

(71) Applicant: Margaret Platt Borgen, Des Moines, IA (US)

(72) Inventors: Arden Borgen, Des Moines, IA (US); Paul Borgen Harbor, Iowa City, IA (US); Jeffrey Merrill, Urbandale, IA (US); Almir Besic, Johnston, IA (US)

(73) Assignee: Margaret Platt Borgen, Des Moines, IA (US)

( * ) Notice: Subject to any disclaimer, the term of this patent is extended or adjusted under 35 U.S.C. 154(b) by 0 days.

(21) Appl. No.: 15/614,252

(22) Filed: Jun. 5, 2017

Related U.S. Application Data

(60) Provisional application No. 62/346,281, filed on Jun. 6, 2016.

(51) Int. Cl.
*A47F 3/04* (2006.01)
*F25B 21/02* (2006.01)

(52) U.S. Cl.
CPC ..... *A47F 3/0482* (2013.01); *F25B 21/02* (2013.01)

(58) Field of Classification Search
CPC ..... A47F 3/0482; A47F 3/0491; F25B 21/02
See application file for complete search history.

(56) References Cited

U.S. PATENT DOCUMENTS 2,029,860 A * 2/1936 Daemicke ..... A47F 3/0491 62/257
2,136,232 A * 11/1938 Bromann, Jr. ..... A47F 3/0404 62/257
2,382,599 A * 8/1945 Blair ..... A47F 3/0404 62/248
4,898,004 A * 2/1990 Richardson ..... A47F 3/0408 62/255
5,924,297 A 7/1999 Wolff et al.
6,185,951 B1 2/2001 Lane et al.
6,883,343 B2 4/2005 Lane et al.
6,889,514 B2 5/2005 Lane et al.
6,915,652 B2 7/2005 Taber et al.
(Continued)

FOREIGN PATENT DOCUMENTS

WO WO2008/082390 * 7/2008

*Primary Examiner* — Cassey D Bauer
(74) *Attorney, Agent, or Firm* — Camille L. Urban; BrownWinick Law Firm

(57) ABSTRACT

This disclosure provides a refrigerated display case for maintaining food freshness and improving food safety while reducing the possibility of spoilage and reducing the labor otherwise required for cleaning a standard case where contaminates commonly accumulate. This structure improves humidity levels by avoiding condensation on lower coils while reducing the complexity of adequately cleaning the case and maintaining food safety. Elimination of this hidden cavity reduces cleaning time. The disclosure employs a removable floor assembly or chilled floor component which may be employed in gravity cases or forced air cases. The removable assembly comprises encased cooling coils which may be foamed in or otherwise secured therein. The floor assembly is removable, making the floor and cooling system an integrated and replaceable component. The novel case further incorporates accessible expansion valves which may be adjusted without removing the food product from the case. Electro thermal cooling means may be alternatively employed.

9 Claims, 6 Drawing Sheets

(56) References Cited

U.S. PATENT DOCUMENTS

| | | | | |
|---|---|---|---|---|
| 7,574,869 | B2 | 8/2009 | Shapiro et al. | |
| 8,020,391 | B2 | 9/2011 | Swofford et al. | |
| 8,377,030 | B2 | 2/2013 | Hyde et al. | |
| 8,579,015 | B2 | 11/2013 | Stark et al. | |
| 2011/0271701 | A1* | 11/2011 | Stephens ..... | A47F 3/0491 62/255 |

* cited by examiner

REFRIGERATOR DISPLAY CASE

CROSS-REFERENCE TO RELATED APPLICATION

This application claims the benefit of U.S. Provisional Patent Application No. 62/346,281 filed with the United States Patent and Trademark Office on Jun. 6, 2016, the entire contents of which are herein incorporated by reference.

BACKGROUND

1. Field

The invention relates to a cooling display case comprising an openable enclosure having an interior. In at least one nonlimiting example of the invention, the enclosure has a first perimeter, no bottom surface and no covering. In at least one nonlimiting example of the invention, the case further includes a removable chilled floor component comprising a perimeter, cooling means, a cooling surface, and a lower surface opposite the cooling surface, positioned substantially in the interior with the chilled floor component perimeter within and removably in contact with the first perimeter of the enclosure of the case.

2. Description of the Related Art

It has long been known that maintaining meat and certain other products within a given cool temperature range extends the life of the product. To that end, the refrigerator and other cooling devices have been devised. Many of these kinds of cooling devices are employed by grocery stores and restaurants as a means not only to maintain freshness of a product, but also as a means to display the product in an appealing manner to encourage the consumer to purchase. Most refrigerated cases include a top, a floor, two sides and a front and a back surface enclosing a space therebetween which is cooled. In the space may be shelves which span side to side but usually do not "seal" the case therefore allowing air movement in the case for the purpose of cooling. In addition, the deck (also referred to as deck pans) in the inside of the case is positioned above the floor and the space between the floor and the underside of the deck is often called the "tank". The tank typically houses some of the mechanics of the case including cooling coils, valves and hoses.

The general operation of a refrigerator is well known in the art. Its cycle can be described, generally, as the compression and condensing of volatile gas to a liquid, allowing the liquid to flow through an expansion valve which causes the liquid to boil and vaporize almost immediately, resulting in a temperature drop which causes the refrigerator with which the vaporized gas is in contact to become cold. The gas is then recycled to the compressor and the cycle repeats. Refrigerated display cases typically rely on the process of convection to transfer heat out of the products and the case to keep the products they display cold. These types of cases work by using either forced air or gravity convection to circulate cooled air through the case. Some or all of the air is cooled typically by a coil placed under the floor of the case in the tank. As the cooled air flows over the product, the difference in temperature between the air and the product causes heat to move from the (relatively) warmer product to the cooler air. Most convection-cooled display cases accomplish this heat transfer in one of two ways. In the most common way, fans drive the circulated air. This method is called forced-convection. But even though convection heat transfer has been used to refrigerate perishable products for decades and remains the most widely used method throughout the industry, forcing air over unpackaged products has certain significant drawbacks.

In order to maintain the product at a cool temperature, a lot of air has to flow over it. One side effect of cooling the surfaces of a display case is formation of condensation on the coils. As the volume of air flowing over the product increases, so too does evaporation from the surface of the product. Fresh meat is sold by the pound; the loss of water weight means a lower selling price. Further, products from which moisture has been removed are often perceived as being of lower quality; it appears dried out, and taste may also be diminished.

Further, evaporated moisture from the product in a cooling application is carried away as water vapor. When the water vapor contacts the cooling coils in the case it freezes and forms frost. Moisture that helped to maintain freshness and case humidity gets frozen on the coil. The case will eventually employ a defrost cycle during which the frost melts and drains to the bottom of the case. This condensed moisture and food particles over time, encourage the growth of certain bacteria and molds. These contaminants which flow to the tank below the display pans, and the resulting mold which can form there, are hidden from view. Access is difficult and cleaning is time consuming. This is true in forced air or in gravity cases.

As an alternative to employing forced-air convection, gravity cases are becoming a more popular form of cooling device for supermarkets and grocery stores to effectively merchandise fresh meat and seafood product. In gravity refrigeration, food is cooled through convection, with coils at the top of the case dropping cool air down to the product below. As air warms in the case it rises to the top of the case where it is cooled by upper coils before descending to cool the product below. Manufacturers normally place cooling coils at the top and under the bottom display deck of the case. Some display case manufacturers also use fans in "gravity" cases to help circulate the cool air, but true gravity convection does not use any forced air to cool product. Without fans, a gravity case runs more effectively and doesn't dry out the food as much. Some manufacturers also include features such as two-pane glass to make the case more energy efficient by helping to maintain consistent cold temperatures throughout the display case. In short, a variety of designs and mechanisms have been employed in attempts to adequate cool the food products in a case without overdrying them and, still, the twin challenges of adequate cooling without drying and efficient and adequate cleaning remain in the prior art.

A gravity case that does not employ fans and maintains a controlled temperature level would be expected to increase product sales. Meat and seafood products last much longer when displayed at consistently cool temperatures without drying out the product with forced air; this translates to a higher proportion of items sold before becoming unsaleable.

Besides forced convection and gravity cases, heat can alternatively be transferred from goods in a case by conduction. Heat may be transferred by conduction through the direct physical contact of two objects (or surfaces) at different temperatures. As is well known in the art, heat flows between any two objects that are in contact with one another, from the warmer surface of one to the cooler surface of the other until both reach the same temperature, or equilibrium. However, regardless of the method of cooling, food safety remains critical.

The success of conduction cooling relies on temperature control of the display pans. The flow of coolant under the deck pans is y typically cycled between a low set point of (e.g., 29 F) and a high set point (e.g., 33 F). This temperature cycling is typically accomplished through a control system that actuates a solenoid valve to start and stop the coolant flow. When the temperature at the deck-pans reaches the high point of the accepted range, the valve opens allowing coolant to flow through the deck-pans. When the temperature reaches the low point, the valve closes stopping the coolant flow.

In addition to simply chilling the air inside a case to keep food fresh, there are prior art cases that have attempted to employ a chilled shelf with limited success. For example, U.S. Pat. No. 6,915,652 discloses a temperature controlled case for storage and display of chilled food products comprising at least one compartment for product storage. A shelf within the compartment is configured to hold the products and a cooling device is positioned above the shelf. A refrigeration system operatively associated with the compartment is configured to circulate a cooling medium through at least one of the cooling device and the shelf so that a desired temperature may be maintained within the compartment for storage of the products. The case includes a defrost system configured to use ambient air to warm the cooling medium so that the warmed cooling medium may be circulated to defrost at least one of the cooling device and the shelf. The shelf may be divided into separate sections. U.S. Pat. No. 6,883,343 to the same owner describes in detail the shelf. In this version, a temperature controlled case is described as comprising at least one compartment for product storage, an opening, a shelf through which a refrigeration system circulates coolant, and a cooling coil above the shelf. Finally, U.S. Pat. No. 6,889,514 discloses a temperature controlled case for storage and display, which comprises a compartment for product, an opening, a shelf, a coil above the shelf, a refrigeration system configured to circulate a coolant to at least one of the shelf and the coil, a defrost system, a flow regulation device for controlling flow rate to the shelf (and coil).

The aforementioned attempts are drawn to a cooling shelf which sits above a compartment of sorts, a tub, or (a tank). These patents (and almost all prior art refrigerated cases) position various components in this compartment or tank that are dedicated to the workings of the case. The cases described above that have attempted to employ a chilled shelf employ two cooling systems, two cooling mediums, a relatively elaborate heat exchanging regime, hoses and tanks. Further, all of the cleaning issues present in prior art remain.

In addition, prior art methods fail to effectively eliminate condensation from the bottom side of the shelf, or deck pans resulting in reducing humidity in the case and causing dripping on product displayed below the shelf. As a further drawback, since a tank is below the bottom shelf, this condensation drips into the tank. In the condensate are, of course, food particles. The condensate containing food particles may then travel to the tank where the condensate lays on all of the inner workings of the case thereby contaminating all of the nooks and crannies along with the equipment positioned in the tank. In order to clean prior art cases, the shelves and the deck separating the tank from the case have to be removed and the coils and other equipment resident below the shelf and in the tank are removed and cleaned or, have to be cleaned in place. Every surface both above the tank and all within the tank have to be decontaminated regularly. This routine requires both labor and downtime, as well as a transfer of the food product, adding another possibility of contamination. Yet, the alternative of not cleaning as often or as well, represents a health risk so significant as to be completely unacceptable.

What was needed was a case that embodies precise execution of the refrigeration concept. Further, a case that improves ease of cleaning, and eliminates major places for formation of microbes and mold would be desirable. Also a chilled floor component to replace the usual deck, exposed coils, valves and hoses, plus the tank itself provides several advantages. In addition, a case that allows for replacement of the chilled floor would be beneficial. It would further be advantageous for the new case to provide ease and convenience in tuning of the expansion and control valves. Additionally, a new refrigerated display or merchandising case that improves the retention of humidity while, at the same time, avoiding condensation of humidity on the under floor coil is desirable for retaining product quality and reducing labor required to maintain the case. Finally, a case that meets these objectives more simply than prior art by avoiding the complexity inherent in operating dual cooling systems employing different mediums would be advantageous.

SUMMARY

The typical prior art refrigerated case may be of the display sort one would find in restaurants, markets, and grocery stores which usually include some portion of clear glass through which product refrigerated in the case may be viewed. Alternatively, the case is not required to include a viewing aspect. The case may be a gravity case which cools food through convection, with coils at the top of the case to cool warm air rising from below and drop the cool air down to cool the product in the case. Avoiding use of fans and maintaining generally consistent cool temperatures in the case would provide the benefit of less drying of the product, improve quiet air conditions in the case, and increase the average shelf life of food products in the case thereby reducing non-sale due to spoilage and increase sale of inventory.

The problem with current technology and prior art coolers is the presence of structure, including a tank, that fosters and encourages microbial growth and are difficult to access for adequate cleaning. Coils are typically placed underneath the bottom display deck or surface 3000 (See FIG. 1, Prior Art) (a.k.a. display pans) of the cooler and above the lowermost surface in the tank. Referring to FIG. 1, prior art, the coils 2000 are, in turn, usually positioned in the open tank 4000 or other flooring shaped to catch any condensation coming off the coils or off the bottom side of a shelf. In an open case, such as shown at FIG. 4, forced air coils 400 may be employed. The low temperature coils result in condensation of moisture on the coils or bottom side of a shelf which, in turn, may encourage growth of microbes on the coils and in the tank while reducing the shelf life of the food products in the case through dehumidification. In order to adjust expansion valves to desired conditions, the food product must be removed, the floor removed or cooling panels lifted, and the valve adjusted, and the product replaced. This adjustment may need to be repeated to achieve the desired conditions, each time requiring removal and replacement of the product.

The present invention comprises a refrigeration case for maintaining food freshness and designed to minimize bacterial growth by eliminating hard-to-clean places where bacteria might otherwise grow in the case. The present invention includes no such exposed coils underneath the cooler's bottom display surface; it includes and requires no tank below the bottom shelf to house the coils. This is a departure from the typical, known, and standard cases. There are, therefore, no loose pieces of the display surface, to be removed and cleaned; there are no hidden areas to accumulate debris or contaminates, and no components such as a tank under the display surface to be cleaned. The cooling system or conductive chilled floor component (used interchangeably herein) of the present invention is sealed in such a manner that condensation cannot form. The underside of the display surface is not exposed to cool/warm dichotomy because it is not positioned within a tank and will not, therefore, contribute condensation and bacterial growth to a tank. This represents a paradigm shift in chiller/cooler design.

The present invention addresses problems of the prior art by providing, in addition to the cooled air flow, a conductive chilled floor component (or chilled floor component) which functions as a floor of the case. The chilled floor component doubles as the surface on which product may be placed and maintained at preservation temperatures and which forms the lower surface of the interior of the case or display area. The chilled floor component participates in the cooler's structure providing torsional and beam strength. The chilled floor component is designed to be a removable, replaceable component in which the cooling coils are integrated. The coils may utilize refrigerant or secondary coolants or any material capable of being circulated and which transfers heat. For example, glycol or other fluids work well. Alternatively, the cooling means may comprise other cooling means, e.g., electro thermal means. The invention represents a departure from typical prior art which employs a deck comprising pans which are located spaced from and above coils which are positioned in the tank. The space and coils below the prior art deck accumulate food particles and, over time, become contaminated. Cleaning then requires partial disassembly and time in order to adequately disinfect the space and equipment positioned below the deck. The present invention eliminates this issue altogether.

The surface of the inventive cooling system's chilled floor component provides additional thermal transfer through direct contact; cooling means are encased in the chilled floor component and are not exposed to the interior of the case and, therefore, no moisture condenses on the coils, and the coils do not need to be cleaned. This alone represents a sea change from the prior art. It is contemplated that the chilled floor component may be of nearly any shape, and may be shaped complementarily to the case; it may comprise dimensions including at least a depth adequate to house the cooling means in a sealed component. The bottom of the chilled floor component is insulated to prevent heat gain into the case from the ambient condition surrounding the case. Because of the case's construction having a removable floor (the cooling system or chilled floor component), the expansion or control valves for the case are accessible from outside the case and may be adjusted without removing the food product from the case. Again, this change alone creates yet another revolutionary advantage over prior art cases.

The chilled floor component's cooling surface serves as the interior floor of the case embodying a top cooling surface, which can, but is not required to, use the same refrigerant or coolant as the rest of the case. The opposite surface of the chilled floor component serves as the bottom, outside surface of the case. There is no tank. The cooling system is modular for removal and replacement.

Cleaning is vastly simplified in the current invention because all surfaces and components to be cleaned are visible and accessible. This is unlike prior art, which requires repositioning display pans and lower coils in order to access hidden areas thereunder where contaminates accumulate. Further, maintenance is reduced because there are no flexible refrigeration components, which are prone to failure, but are required in order to accommodate movable coils. Here, no movable coils are required. Finally, expansion or control valves, are positioned on the exterior of the case making control and cleaning much easier.

BRIEF DESCRIPTION OF THE DRAWINGS

Example embodiments are described in detail below with reference to the attached drawing figures, wherein.

DETAILED DESCRIPTION

Figure 1:
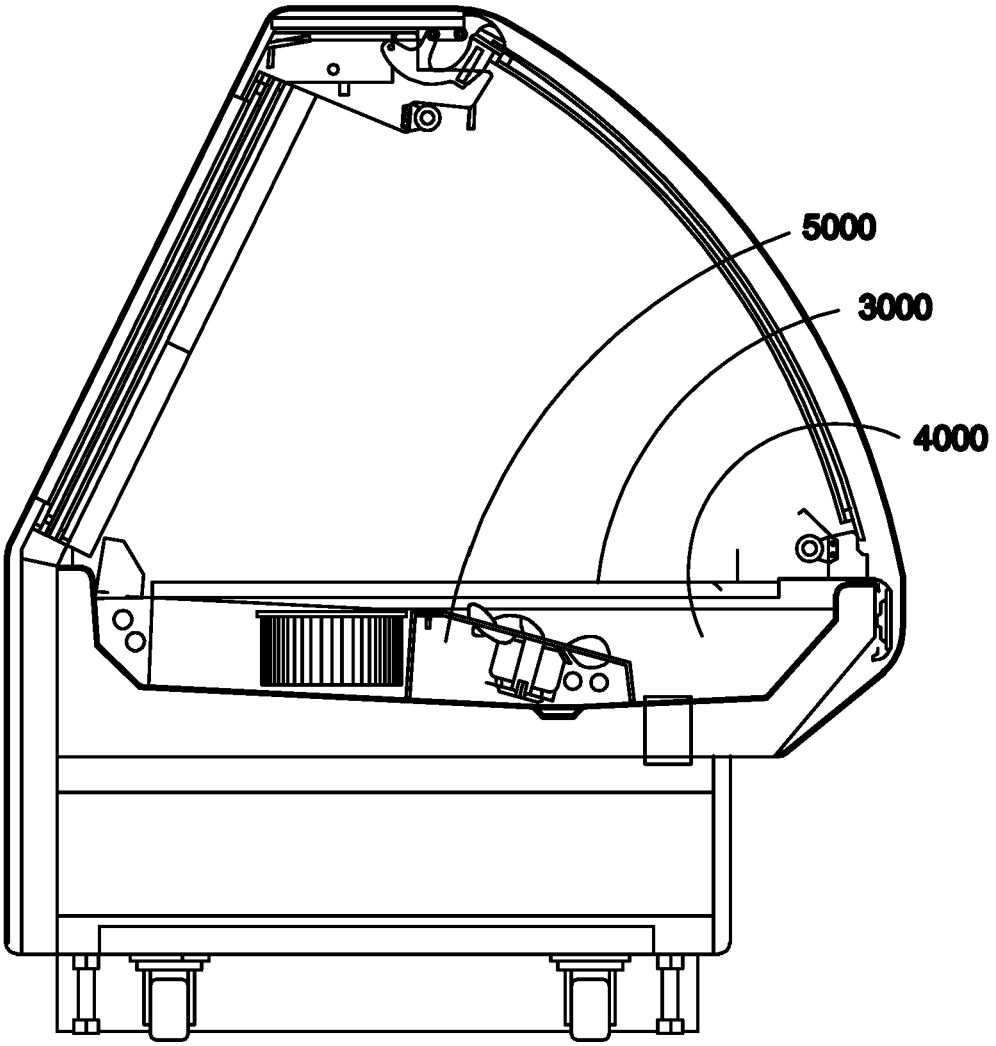
Fig. 1 (Prior Art)
FIG. 1 a side view of a cooling case of the prior art.
Figure 2:
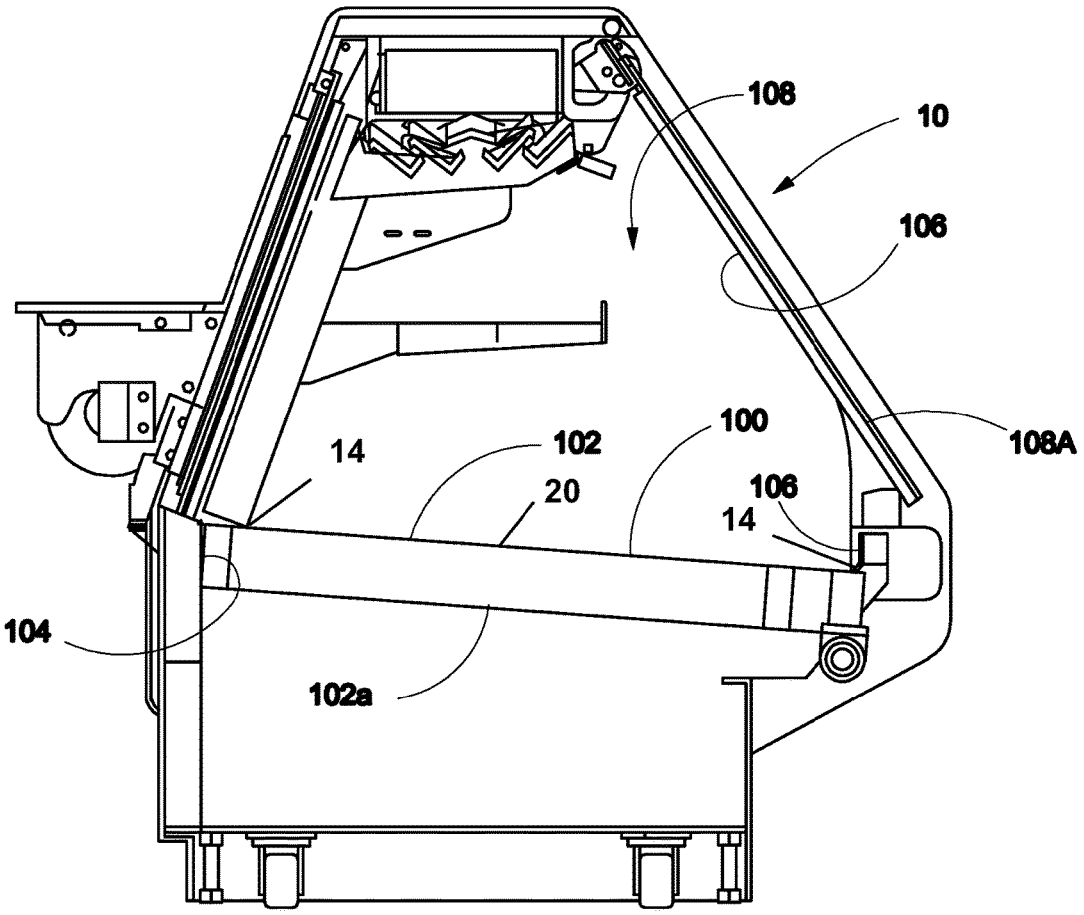
FIG. 2 a side view of a cooling case comprising the modular conductive chilled floor component of the present invention.
Figure 3A:
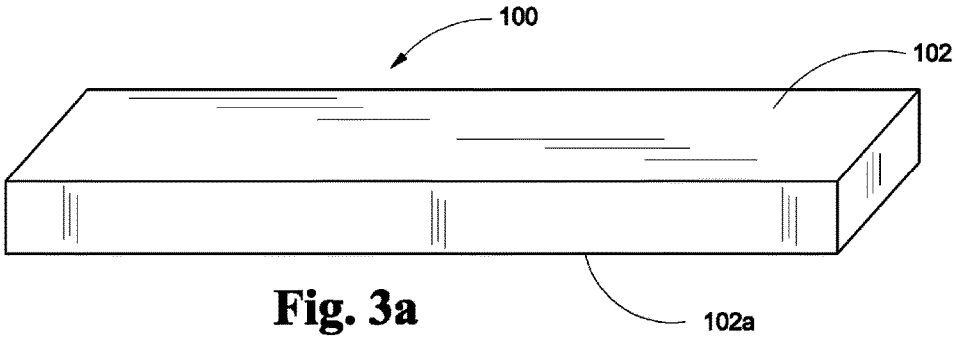
FIG. 3A is a perspective view of the conductive chilled floor component.
Figure 3:
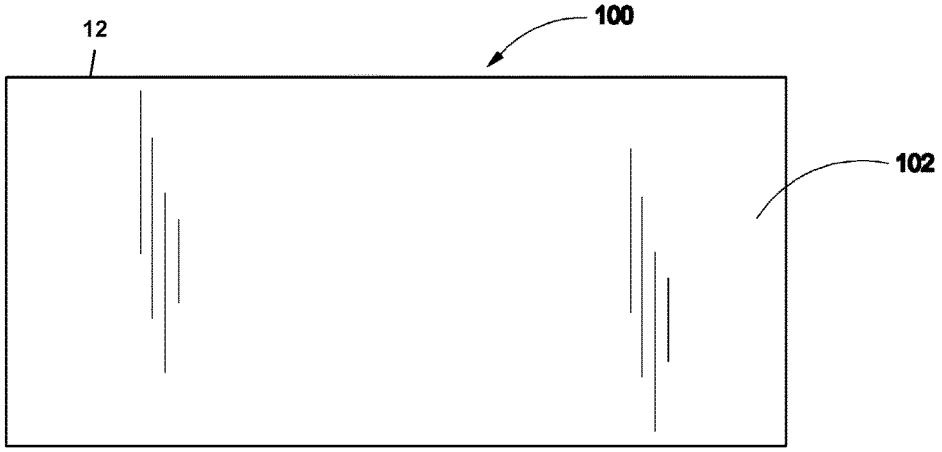
FIG. 3 top view of the conductive chilled floor component.
Figure 3B:
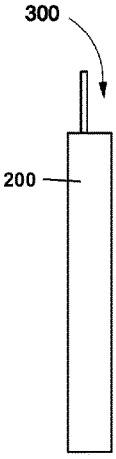
FIG. 3B is an end view of a first end of the conductive chilled floor component.
Figure 3C:
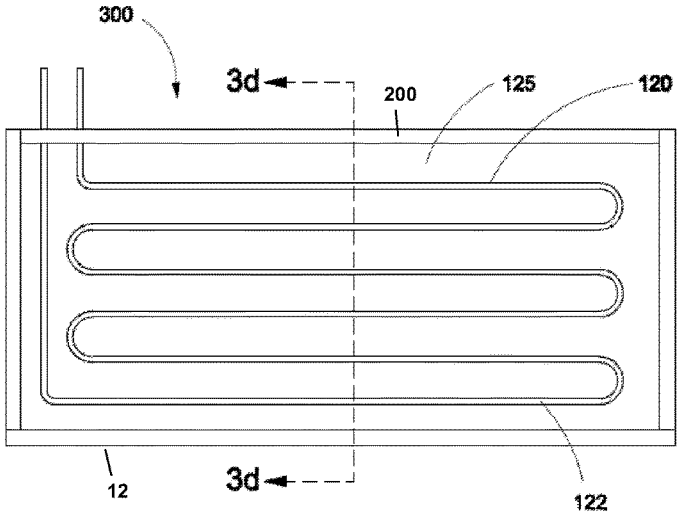
FIG. 3C is a plan view, through the conductive chilled floor component showing the coils.
Figure 3D:
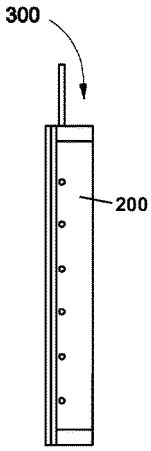
FIG. 3D is a cross section of the conductive chilled floor component.
Figure 4:
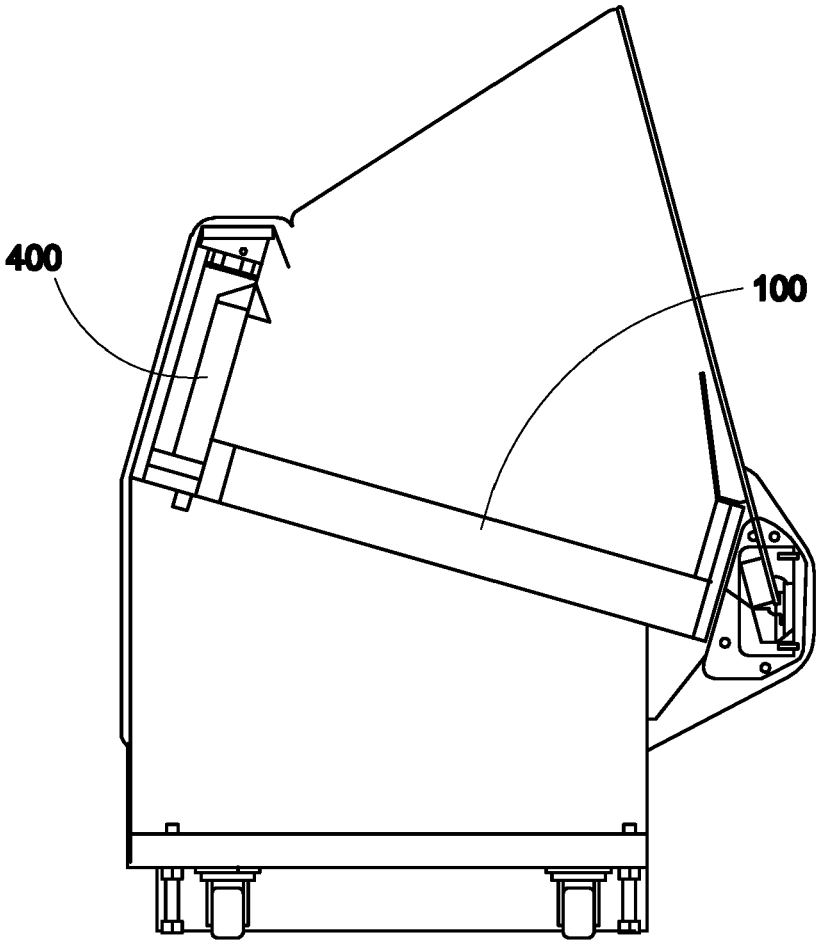
FIG. 4 is a side view of an open refrigerated case comprising the modular conductive chilled floor component of the present invention.
Figure 5:
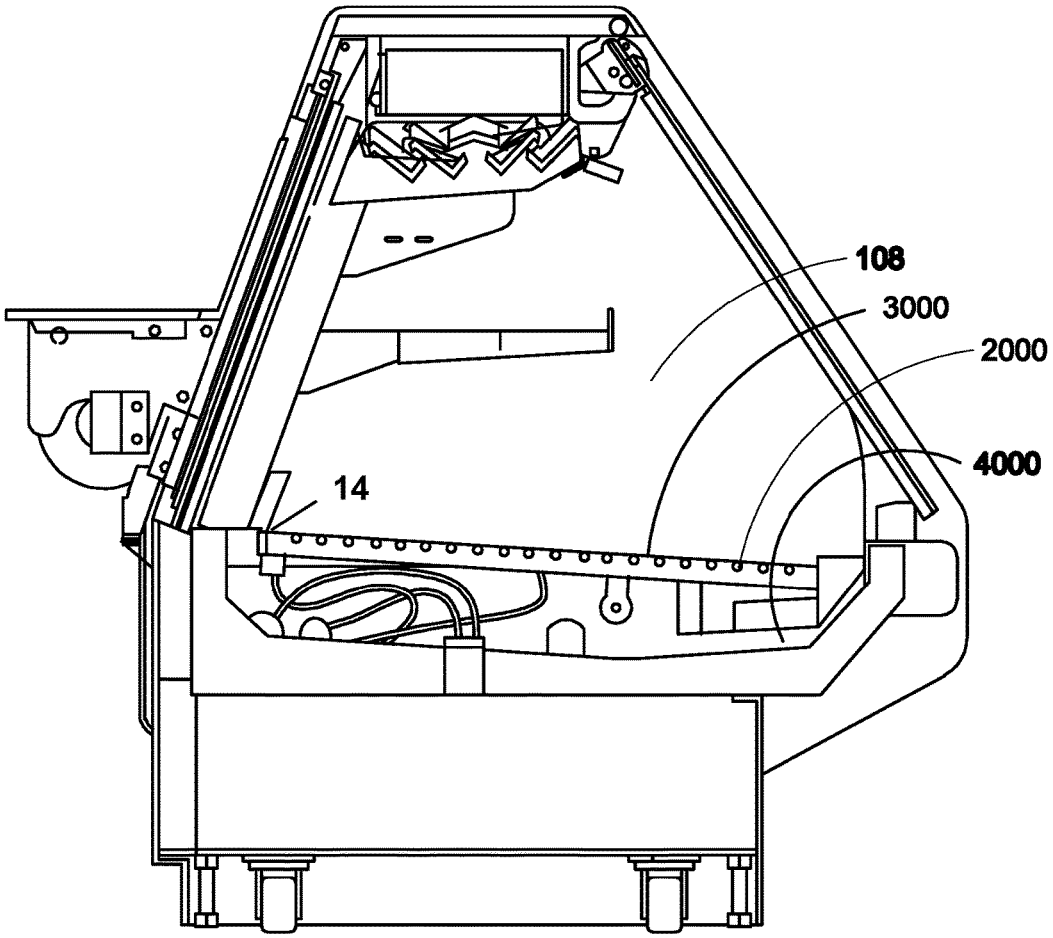
Fig. 5 (Prior Art)
FIG. 5 is a side view of a prior art refrigerated case.

Example embodiments will now be described more fully with reference to the accompanying drawings. Example embodiments are not intended to limit the invention since the invention may be embodied in different forms. Rather, example embodiments are provided so that this disclosure will be thorough and complete, and will fully convey the scope of the invention to those skilled in the art. In the drawings, the sizes of components may be exaggerated for clarity.

The present invention comprises a modular conductive cooling system or conductive chilled floor component or chilled floor component 100 designed to work in a cooling display case 10. The case 10 may be a gravity case or other cooling case. The modular conductive cooling system or chilled floor component 100 comprises a deck or cooling surface 102 preferably comprised of a shape to serve as a lower surface or floor in the interior of the case 10, a chilled floor component perimeter 12 and sized to fit, generally, against internal surfaces 104, 106 of an enclosure 108 of the case 10 or a first perimeter 14 of the enclosure 108 to prevent moisture from traveling down the internal surfaces 104, 106 of the enclosure 108 of the case 10. The enclosure 108 may be openable. For example via door 108A which may be hinged or sliding or otherwise movable or removable. However, the means by which the enclosure may be openable may be of any other conventional means known to one of ordinary skill in this art.

The modular conductive cooling system or chilled floor component 100 is sized and constructed to serve as structural and torsional support for the case 10 by fitting against internal surfaces 104 and/or 106. The modular conductive cooling system or chilled floor component 100 comprises cooling means 300. In one embodiment, cooling means 300 comprises a plurality of coils 120 for housing cooling liquid which may include gaseous materials, refrigerant or any other material capable of flowing and transferring heat 122. However, the essential requirement is that the chilled floor component 100 may be cooled adequately which may be achieved via electro thermal or other known cooling approaches, all of which are contemplated by the present invention. Where coils are employed, the coils 120 may be secured substantially or completely within the modular conductive cooling system 100 by foam 150, preformed cavities 152, or other means and, in some embodiments are sealed therein. The modular conductive cooling system chilled floor component 100 has an interior 125 which may be airtight, sealed, or at least constructed such that the coils 120 positioned in the interior 125 have little or no exposure to air so as to generally eliminate frost, condensation, and subsequent microbe, fungus, and mold growth that would otherwise be expected. Alternative cooling means may be employed, such as electro-thermal means.

The deck or cooling surface 102 of the modular conductive cooling system or chilled floor component 100 serves as the floor 20, 102 in the cooling display case 10. The chilled floor component 100 is especially designed to be removable and replaceable. The coils 120 internal to the chilled floor component 100 may be foamed-in-place 150 or otherwise secured in position; cavities 152 may be prefoamed into which the coils 120 are fitted and secured. It is contemplated that the chilled floor component 100 may comprise a container 200 in which the coils 120 are housed; the container 200 may be formed such that the coils 120 are fitted into specially constructed, insulated, cavities 152 in the container 200. Alternatively, the container 200 may consist of a material 302 which may be an insulating permeative material, foam or otherwise, surrounding the coils 120 which may be applied in liquid form and molded to provide the structural support described and the floor 20. The cooling system chilled floor component 100 may include a chilled deck (cooling surface) 102 and a noncooling side 102*a* opposite the cooling surface 102.

The present invention includes no coils separated from and underneath the cooler's bottom surface; it includes no tub below the coils. There are, therefore, no loose pieces of the floor, coils, or tub to be removed and cleaned; there are no hidden areas to accumulate debris, and no components such as a tub under the floor panels to be cleaned.

The modular conductive cooling system (chilled floor component) 100 is designed to be a removable, replaceable component in which the cooling coils 120 or other cooling means describe herein are positioned. The chilled deck or cooling surface 102 provides additional thermal transfer through direct contact; the coils 120 encased in the chilled floor component 100 are not exposed to the interior of the case 10 and, therefore, no moisture condenses on the coils 120, and the coils 120 do not need to be cleaned. The coils 120 of the present invention are preferably sealed or substantially enclosed in such a manner that condensation cannot readily form on the coils, thereby eliminating or at least greatly reducing the effects of moisture in the case. Further, the sealed chilled floor component 100 is easily removed and replaced. This reduces down time otherwise needed for repair and, in accordance with the invention, provides a single, mostly uniform surface that serves as the deck or floor 102, 20 of the case 10. The material comprising the deck or floor 102, 20 of the chilled floor component 100 is purposefully selected to provide ease of cleaning. It is contemplated that the deck or floor 102, 20 may be of nearly any shape, or may be shaped complementarily to the case 10; it may comprise dimensions including at least a depth adequate to house the coils 120 and a generally enclosed interior 125 space into which the coils 120 are positioned. Coolant may include gaseous refrigerants, secondary coolants, and other fluid capable of transferring heat. The coils 120 may be integrated into the base surface by molding the interior surface 125A of the chilled floor component 100 specifically to fit the coils 120, or by foaming in the coils 120, or by other means to secure in position the coils 120 within the chilled floor component 100. In some embodiments, the coils 120 are removably secured in the chilled floor component 20 to allow for replacement of coils 120 as needed and for simplifying cleaning and maintenance; in others, the coils 120 are foamed in and may not be intended to be replaceable except when replacing the chilled floor component 100. In still other embodiments, the coils may be submerged in or surrounded by a liquid or foam product which is then allowed to harden thereby creating the chilled floor component 100 and the floor/deck 102, 20. Alternatively, a planar material may be affixed or otherwise associated with an upper surface of the hardened material to serve as the floor/deck 102, 20. Because of the modular conductive cooling system's construction allowing it to be removable, the controls 160 and expansion valves 165 for the case are externally mounted and accessible, making them adjustable without removing the food product from the case.

The present invention represents a paradigm shift in how a refrigerated case works as well as how it is maintained. By avoiding the need to remove and sanitize coils by encasing the coils and by eliminating an otherwise useless space beneath the floor that served as a breeding ground for dangerous microbials, the present invention has revolutionized the decades old way of displaying and merchandising meat and fish products, markedly changed the labor involved in maintenance and sanitation in a meat department of a store, and increased the probability of displaying foods in a case free of dangerous levels of contamination.

The present invention has been described in a manner such that one of ordinary skill in the art will fully comprehend its inventive nature. Claims describing the invention more particularly are presented.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What we claim is:

1. A cooling display case comprising:

a. an enclosure having an interior openable space;

b. said interior openable space comprising a first internal perimeter and a plurality of internal surfaces;

c. removable, replaceable chilled floor component comprising: a floor perimeter, a planar configuration, cooling means, a cooling surface, and a noncooling side; wherein said cooling means are positioned within the removable, replaceable chilled floor component between said cooling surface and the surface opposite said cooling surface of the chilled floor component; wherein said chilled floor component is positioned substantially in the interior openable space; wherein substantially all of the chilled floor component perimeter is in removable contact with the internal perimeter of the interior openable space thereby forming a moisture barrier between the cooling surface and the surface opposite the cooling surface; and wherein the cooling surface of said chilled floor component forms a floor of the interior openable space and said noncooling side of the chilled floor component serves as a lowermost outside surface of the display case.

2. The case of claim 1 said chilled floor component perimeter removably associated with the at least one of a perimeter of another chilled floor component and the internal perimeter to facilitate complete removal of the chilled floor component.

3. The case of claim 1 comprising a drainage throughput.

4. The case of claim 1 said cooling means comprising at least one coil, said coils for circulating a coolant.

5. The case of claim 1, said cooling surface consisting of a single, seamless plate.

6. The case of claim 1 wherein said cooling means comprises thermo electric means.

7. The case of claim 1 wherein said case is a forced air case.

8. The case of claim 1 further comprising a throughput standpipe to allow input of pipe or electrical cord.

9. The case of claim 1 wherein said chilled floor component further comprises a drain to allow condensed moisture or cleaning water to exit.

* * * * *